US005826821A

United States Patent [19]

Brandon et al.

[11] Patent Number: 5,826,821

[45] Date of Patent: Oct. 27, 1998

[54] DRAG CONTROL MODULE FOR RANGE CORRECTION OF A SPIN STABIL

[75] Inventors: Fred J. Brandon, Aberdeen; Michael S. L. Hollis, Abingdon, both of Md.

[73] Assignee: The United States of America as represented by the Secretary of The Army, Washington, D.C.

[21] Appl. No.: 912,970

[22] Filed: Aug. 4, 1997

[51] Int. Cl.[6] ..... F42B 10/50

[52] U.S. Cl. ..... 244/3.27; 244/3.1; 244/110 D; 102/293

[58] Field of Search ..... 244/3.1, 3.21, 244/3.24, 3.25, 3.26, 3.27, 3.28, 3.29, 110 D, 113; 102/293, 388, 386

[56] References Cited

U.S. PATENT DOCUMENTS

| | | | |
|---|---|---|---|
| 1,181,203 | 5/1916 | Alard | 244/3.21 |
| 1,201,763 | 10/1916 | Rimailho | 244/3.21 |
| 2,840,326 | 6/1958 | Richardson et al. | 244/113 |
| 3,188,958 | 6/1965 | Burke et al. | 244/3.14 |
| 3,986,683 | 10/1976 | Ellison | 244/3.21 |
| 4,037,806 | 7/1977 | Hirsch et al. | 244/3.16 |
| 4,113,204 | 9/1978 | Leek | 244/3.21 |

FOREIGN PATENT DOCUMENTS

| | | | |
|---|---|---|---|
| 1184673 | 12/1964 | Germany | 244/3.27 |
| 147200 | 10/1954 | Switzerland | 244/3.27 |
| 112718 | 1/1918 | United Kingdom | 244/3.29 |

*Primary Examiner*—Charles T. Jordan
*Assistant Examiner*—Christopher K. Montgomery
*Attorney, Agent, or Firm*—Paul S. Clohan

[57] ABSTRACT

A range correction module which is designed to fit onto a spin stabilized ballistic projectile for correcting range error. The range correction module is a self-contained module within the fuze which screws into the forward portion of the projectile. The range correction module is designed such that changes are not required to the existing projectile. During the course correction phase, sixteen semi-circular plates will deploy from the module. The plates create a blunt cross-sectional area in front of the projectile, thus creating more drag and effectively slowing the projectile.

4 Claims, 4 Drawing Sheets

DRAG CONTROL MODULE FOR RANGE CORRECTION OF A SPIN STABIL

CROSS-REFERENCE TO RELATED APPLICATIONS

The subject matter of this application is related to that disclosed in copending application Ser. No. 08/794,789 filed Feb. 2, 1997.

BACKGROUND OF THE INVENTION

The present invention relates to tube launched projectiles in general, and specifically to a device for one-dimensional trajectory (range) control of spin stabilized projectiles. It was well recognized in the prior art that a tube launched projectile followed a ballistic trajectory which could be fairly well calculated. This knowledge enabled a gunner to fire a projectile to impact a preselected target area with reasonable accuracy and consistency. However, a major disadvantage of a ballistic projectile was the inability to control its trajectory after launch. Course correction is difficult with these types of projectiles. It is well known that the major source of trajectory error is in range, not deflection, for a ballistic projectile. As shown in FIG. 1, projectile 20 is fired from gun tube 24 at intended target B, but due to wind and other meteorological conditions, muzzle velocity error, aiming error, etc., projectile 20 actually impacts at point A. With current technology, at some point along the trajectory of projectile 20, the impact point error can be determined, but a course correction was not possible once projectile 20 leaves gun tube 24.

If course correction was available, the gunner could deliberately aim past the target. Then, during the flight of the projectile, a combination of on-board electronics such as a Global Positioning Sensor (GPS), and/or an Inertial measurement Unit (IMU), and a Central Processing Unit (CPU) would determine the actual ballistic path and predicted point of impact with respect to the intended trajectory and target location. A trajectory (range) control device could be preprogrammed with the intended trajectory before the projectile is fired. At a certain point in the flight, the CPU would determine when to initiate the trajectory (range) control device. Once initiated, the projectile will slow down, ultimately bringing it closer to the intended target.

BRIEF SUMMARY OF THE INVENTION

It is therefore an object of the present invention to provide a simple range correction fuze/module for a spin stabilized ballistic projectile that will enhance range accuracy.

A further object of the present invention is to provide a range correction fuze/module that will provide a cost effective solution to correcting range error in spin stabilized ballistic projectiles.

Still other objects and advantages of the present invention will become readily apparent to those skilled in this art from the detailed description, wherein only the preferred embodiment of the present invention is shown and described, simply by way of illustration of the best mode contemplated of carrying out the present invention. As will be realized, the present invention is capable of other and different embodiments, and its several details are capable of modifications in various obvious respects, all without departing from the present invention. Accordingly, the drawings and descriptions are to be regarded as illustrative in nature, and not as restrictive.

These and other objects are achieved by a range correction device designed to be integrated into the fuze of a spin stabilized ballistic projectile. To minimize the impact on the projectiles overall aerodynamic profile, and physical characteristics, the device is very compact. Our range correction device is also a very cost effective solution to correcting range error. Our range correction module is completely integrated into the fuze, which will screw into the forward portion of the projectile. The mechanisms involved in our device require the fuze "envelope" to be lengthened by only a small amount. This will maintain an overall length of the artillery projectile (including the fuze) of no more than one meter. During the course correction phase, a central locking spline will translate to release sixteen semi-circular plates. The plates create a blunt cross-sectional area in front of the projectile, thus creating more drag and effectively slowing the projectile.

DETAILED DESCRIPTION OF THE INVENTION

Figure 1:
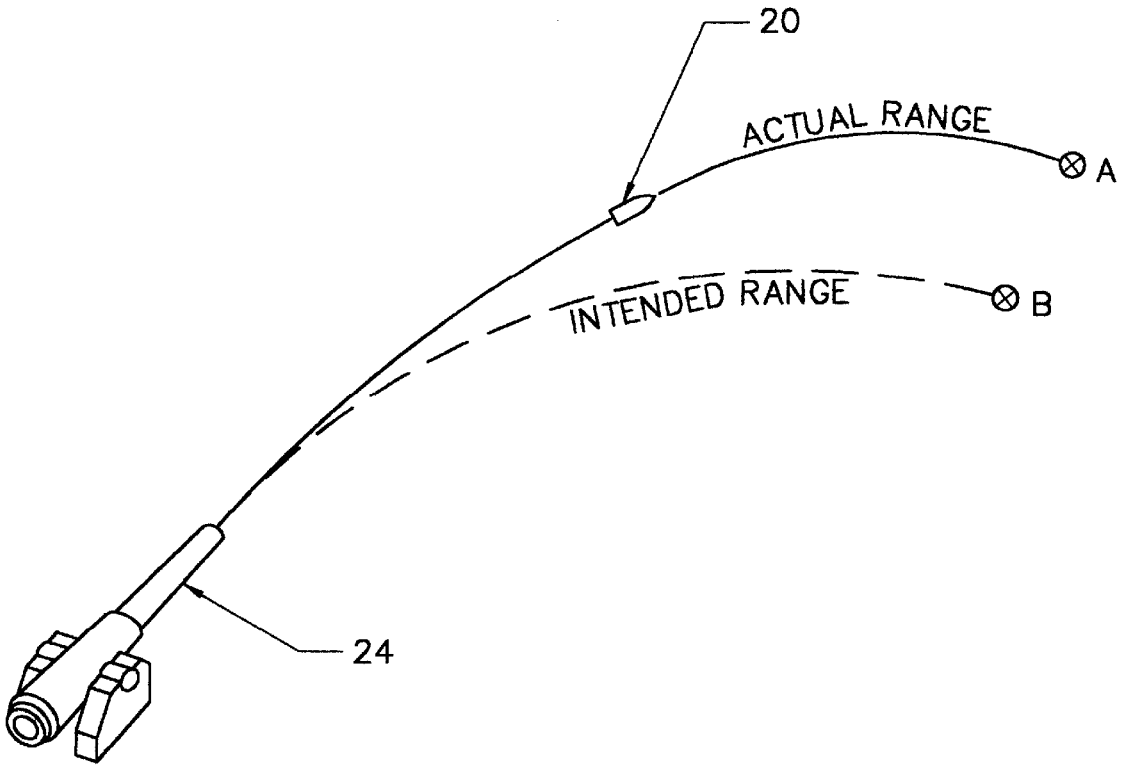
FIG. 1 depicts the intended path and the actual path of a projectile fired from a gun tube.
Figure 2:
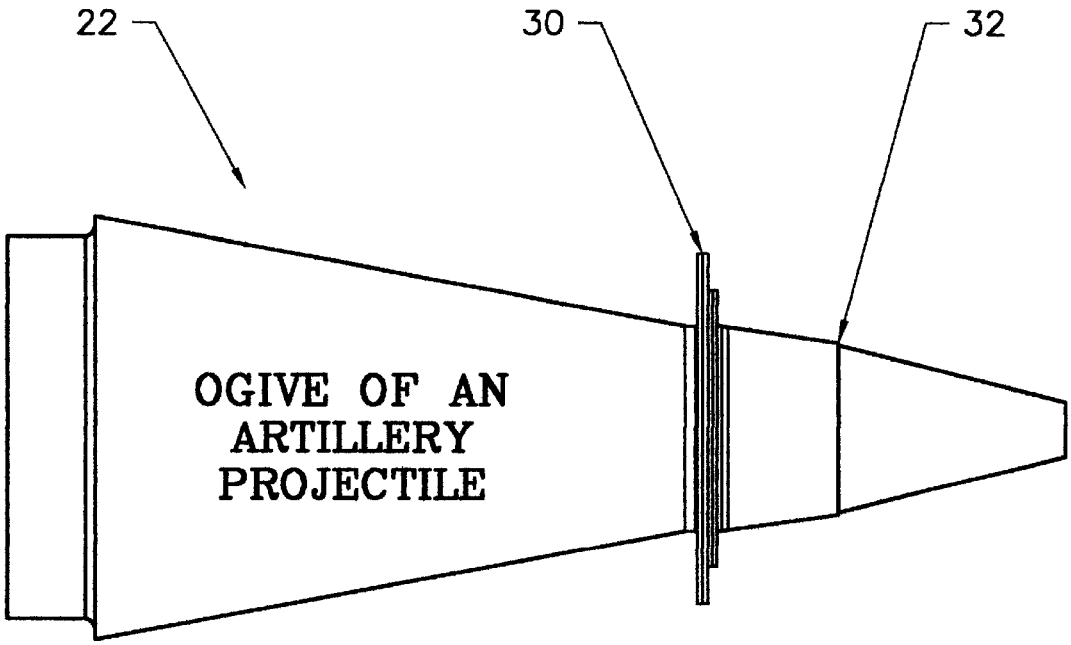
FIG. 2 depicts the forward portion of a spin stabilized ballistic projectile with our range correction fuze/module attached.

Referring now in detail to the drawings wherein like parts are designated by like reference numerals throughout, there is illustrated in FIG. 2 the forward end of ogive 22 of a spin stabilized ballistic projectile 20 incorporating our range correction device 30, which is a self-contained module within fuze 32 which screws into the forward end 22 of spin stabilized ballistic projectile 20. Range correction module 30 has a small hollow bushing that will coincide with the center of fuze 32 and the center of projectile forward end 22. This hollow bushing is intended to provide a conduit through which wires can pass through to provide electrical connections between the forward and aft components of module 30. The intent of range correction module 30 is to provide a device that will not require modification to existing projectiles.

Figure 3:
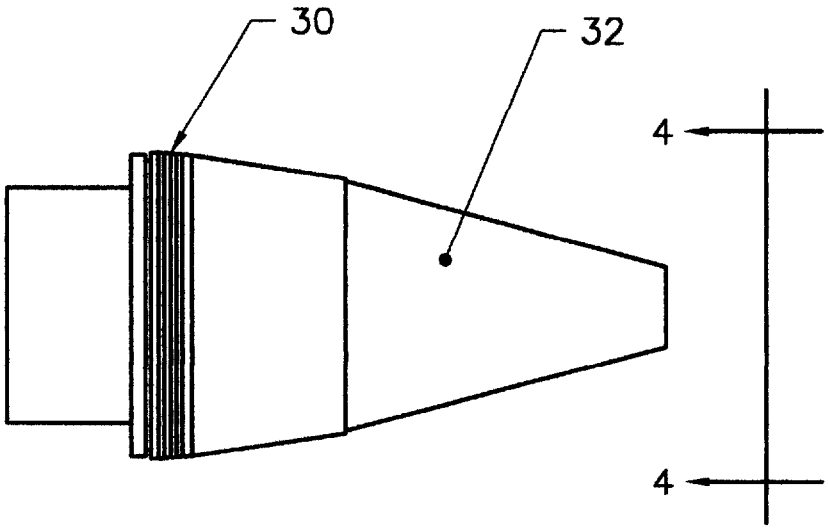
FIG. 3 is a side view of the range correction fuze/moduel before deployment.
Figure 4:
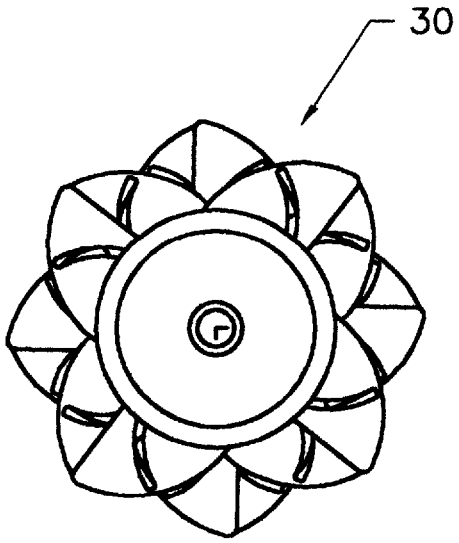
FIG. 4 is a view along lines 4—4 of a spin stabilized projectile after deployment of our range correction module.

A view of the side of the range correction module before deployment can be seen in FIG. 3. During the course correction phase, sixteen semi-circular plates will deploy from range correction module 30. A view from the front of spin stabilized projectile 20 after the semi-circular plates have been deployed in an "iris" like fashion can be seen in FIG. 4. The plates create a blunt cross sectional area in front of projectile 20, thus creating more drag and effectively slowing projectile 20. The drag surface is much larger than that of previous designs, with the diameter of the extended plates being on the order of 100 mm. Aerodynamic simulations have shown an improvement in the range correction capability of 50% to 70%.

Figure 5:
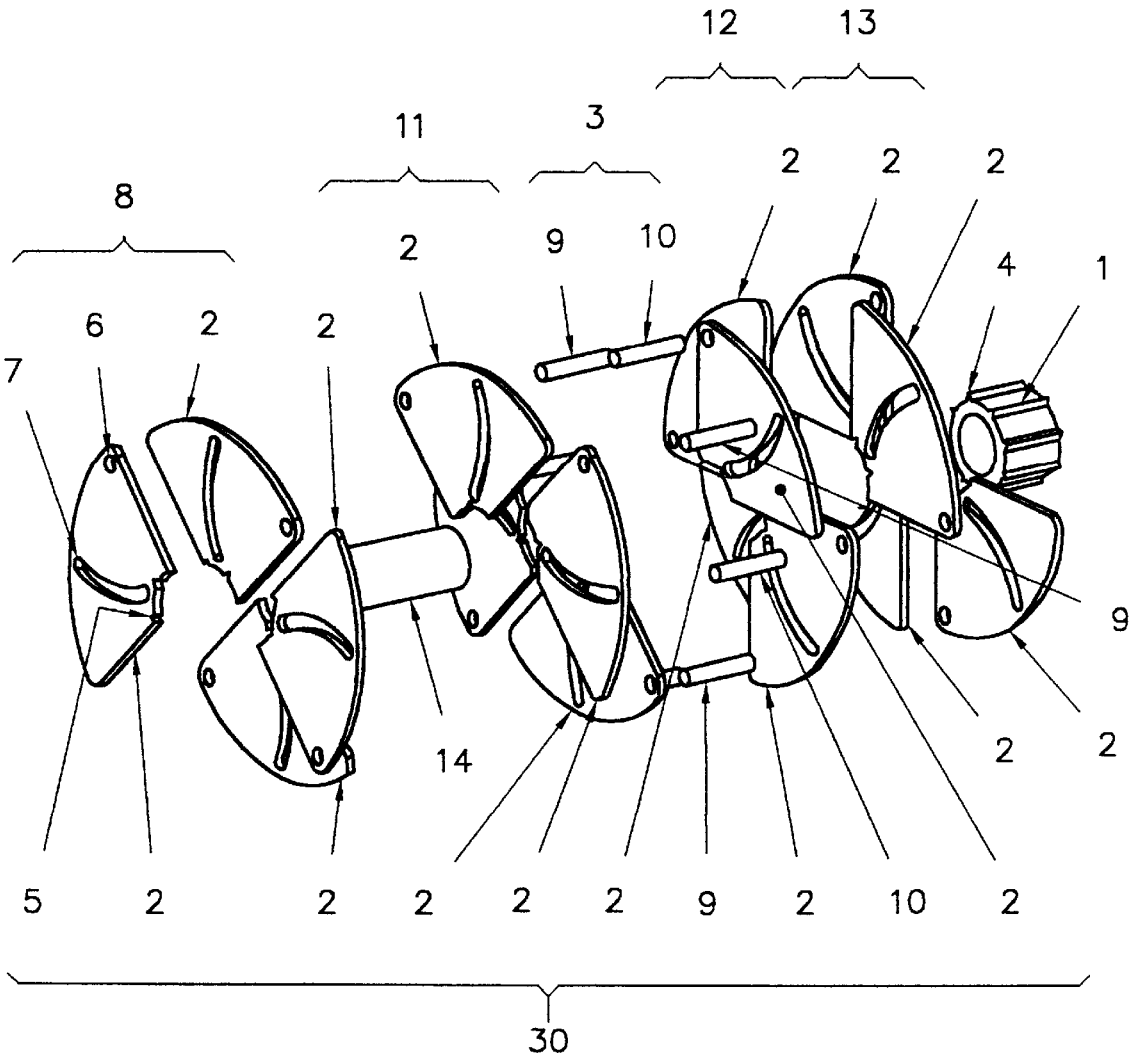
FIG. 5 is an exploded view of the components of our range correction device.

An exploded view of range correction module 30 is shown in FIG. 5. Module 30 consists of central locking spline 1, sixteen plates 2, and eight posts 3. All of plates 2 are locked in place during the launch and pre-deployment phase of projectile 20 flight via central locking spline 1.

Teeth 4 of spline 1 engage grooves 5 on plates 2. At the time of deployment, spline 1 slides forward so that teeth 4 no longer engage grooves 5 on plates 2. Under the high spin rate of spin stabilized ballistic projectile 20, plates 2 will deploy due to centrifugal forces. Plates 2 will pivot about posts 3 which run through plates 2 pivot holes 6. To keep plates 2 from pivoting too far, slot 7 in plates 2 guides the pivot of plate 2 until the end of slot 7 stops at guide post 3.

Depending upon the orientation of plates 2, guide posts 3 act as pivot posts for some plates 2 and as guide posts for other plates 2. The top layer 8 of plates 2 pivot clockwise about pivot posts 9. Slots 7, in top layer 8, slide along guide posts 10, which are located at 45° with respect to pivot posts 9. The second layer 11 of plates 2 utilizes the same pivot posts 9 and the same guide posts 10. However, plates 2 of layer 11 pivot counter-clockwise about pivot posts 9.

The third layer 12 of plates 2 is rotated by 45° such that pivot holes 6 on this layer now pivot clockwise about guide posts 10 of layers 8 and 11. Slots 7 of layer 12 now slide along pivot posts 9 of layers 8 and 11. The forth layer 13 of plates 2 utilizes the same pivot and guide posts as layer 12; however, these plates 2 rotate counter-clockwise about pivot posts 9.

All of plates 2 are locked in place by locking spline 1. Locking spline 1 will sufficiently translate forward by means of an actuator (not shown), such that spline 1 releases plates 2. Spline 1 slides along conduit 14. Conduit 14 acts as a passage way for electrical wires to pass between the forward and aft parts of the fuze.

The overall effect of module 30 is a drag surface created from sixteen plates 2 pivoting outward from the main fuze body. An example of the deployment of module 30, for an artillery projectile 20, would be a one-time course correction. The deployment of plates 2 will be aided by the centripetal forces due to the high rate of spinning by artillery projectile 20. The forces will pull plates 2 out of their respective seating places. The pivot motion of plates 2 is restrained by slots 7 within plates 2 and guide posts 9. Spline lock 1 maintains plates 2 until the time of their deployment.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A device to control the range of trajectory of a spin stabilized projectile comprising:

a drag producing module located in the forward portion of said projectile;

said module comprising a plurality of arcuate surfaces extendable outward from said module in an iris shape so as to slow said projectile during flight;

wherein the outward extendable motion of said arcuate surfaces is controlled by the translation of a splined shaft within said module.

2. The device of claim 1 wherein the outward extendable motion of said arcuate surfaces controlled by a translating splined shaft is assisted by the centripetal forces acting on said module due to the spinning motion of said projectile.

3. The device of claim 2 wherein the translation of said splined shaft is limited to a one time translation controlled by a miniature actuation means.

4. The device of claim 2 comprising 16 arcuate surfaces.

* * * * *